US007392839B1

(12) United States Patent
Wintill et al.

(10) Patent No.: US 7,392,839 B1
(45) Date of Patent: Jul. 1, 2008

(54) SINGLE LINE SLIDING SLEEVE DOWNHOLE TOOL ASSEMBLY

(75) Inventors: Charles David Wintill, Houston, TX (US); Rodney Wayne Long, Cypress, TX (US); William Ryle Darnell, St. Martinville, LA (US); William John Darnell, Houston, TX (US); Michael Chad Darby, Katy, TX (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 11/742,318

(22) Filed: Apr. 30, 2007

(51) Int. Cl.
*E21B 34/08* (2006.01)

(52) U.S. Cl. ..... 166/66.7; 166/183

(58) Field of Classification Search ..... None
See application file for complete search history.

(56) References Cited

U.S. PATENT DOCUMENTS

| | | | | |
|---|---|---|---|---|
| 4,583,593 | A * | 4/1986 | Zunkel et al. | 166/382 |
| 5,826,652 | A * | 10/1998 | Tapp | 166/120 |
| 6,659,186 | B2 * | 12/2003 | Patel | 166/386 |
| 6,983,796 | B2 | 1/2006 | Bayne et al. | |
| 7,216,713 | B2 * | 5/2007 | Read, Jr. | 166/319 |

* cited by examiner

*Primary Examiner*—Frank S Tsay
(74) *Attorney, Agent, or Firm*—Buskop Law Group, PC; Wendy Buskop

(57) ABSTRACT

A single fluid line sliding sleeve downhole tool assembly having a top sub engaging a top connector which connects to a body that engages a middle connector which is secured to a port housing, wherein the port housing engages a lower connector and the lower connector engages a bottom sub.

19 Claims, 8 Drawing Sheets

SINGLE LINE SLIDING SLEEVE DOWNHOLE TOOL ASSEMBLY

FIELD

The present embodiments generally relate to a single fluid line sliding sleeve downhole tool assembly for drilling operations.

BACKGROUND

During production of hydrocarbons from a well, operators may find it necessary to either open a port within a tubular string or close a port within a tubular string. A valve placed in a tubular string can be used to establish communication with the reservoir, or alternatively, to shut-off communication with the reservoir. Several devices have been developed over the years to accomplish the opening and/or closing of ports within tubular strings.

These devices are generally known as sliding sleeves due to the ability of the devices to shift an inner sleeve from a first position to a second position. Sliding sleeves are commercially available from several vendors. One type of sliding sleeve that is commercially available is sold under the name "Otis DuraSleeve" and may be purchased from Halliburton Corporation.

A need exists for a device that can be selectively opened and closed in a well. There is also a need for a device that can be shifted from a closed position to an open position, or alternatively from an open position to a closed position, without harming the seal assembly. There is also a need for a seal assembly within a downhole device that will continue to provide a seal after multiple openings and closings of the downhole device.

The present embodiments meet these needs.

BRIEF DESCRIPTION OF THE DRAWINGS

The detailed description will be better understood in conjunction with the accompanying drawings as follows.

Figure 1:
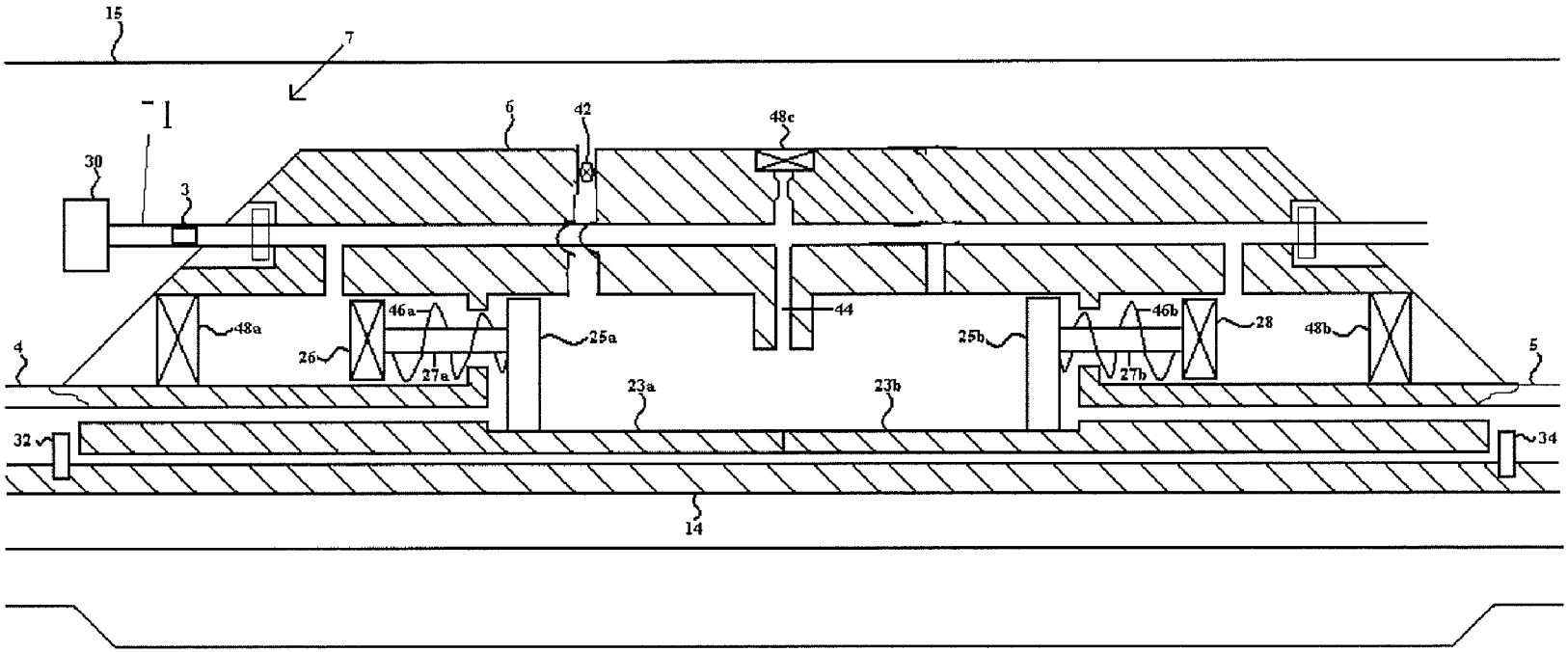
FIG. 1 depicts a cross sectional view of a central section of an embodiment of the present single fluid line sliding sleeve downhole tool assembly.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The present embodiments relate to a single fluid line sliding sleeve downhole tool assembly. More particularly, but not by way of limitation, the present embodiments relate to a downhole tool used in the production of hydrocarbons from subterranean reservoirs and a method of use for said tool.

One advantage of the present embodiments is that the present single fluid line sliding sleeve downhole tool assembly can withstand extreme temperatures and pressures, such as those found within an oil or natural gas well while retaining effective seals and valves.

The present single fluid line sliding sleeve downhole tool assembly can selectively be shifted between open and closed positions under well conditions without causing damage to the assembly, or any seals or components within the assembly, providing an assembly with an improved product life over existing sliding sleeves.

The present single fluid line sliding sleeve downhole tool assembly utilizes parts and materials uniquely suitable to maintain their tensile strength at high temperatures, and further utilizes an arrangement of parts and components that allows the tool assembly to maintain operation in high temperature and high pressure conditions.

The present downhole tool assembly has a top sub engaging a top connector. The top connector connects to a body. The body can be eccentric, concentric, or other shapes. The body engages a middle connector. The middle connector engages a port housing. The port housing can engage a lower connector, which can engage a bottom sub. An annulus port can be disposed in the port housing for communicating fluid between an annulus and tubing.

A sleeve with a production port can be used for axially moving with respect to the body. It is contemplated that through axial movement of the sleeve, the production port disposed in the sleeve can align with the annulus port disposed in the port housing, allowing injection fluid to flow through the aligned ports and into the reservoir.

A first seal assembly can be used to provide a sealing engagement between the sleeve and top connector. A second seal assembly can provide a sealing engagement between the middle connector and the sleeve. A third seal assembly can provide a sealing engagement between the port housing and the sleeve. In an embodiment, a plurality of plugs can be used to provide a sealing engagement between the body and the annulus.

A first piston in communication with a fluid source can be disposed within the body for providing axial movement relative to the body. The first piston moves axially between at least an original position and at least a secondary position.

A second piston can further be in communication with the fluid source and disposed within the body for providing axial movement relative to the body. The second piston moves axially between at least a second piston original position and at least a second piston secondary position. It is contemplated that the second piston can also move axially to one or more intermediate positions. The first piston causes the sleeve to move in a first direction, and the second piston causes the sleeve to move in a second direction.

In an embodiment, a filter can be disposed between the first and second pistons and the fluid source.

The fluid from the fluid source can be a compressible fluid, such as air, nitrogen, argon, helium, or combinations thereof. In the alternative, the fluid can be a non-compressible fluid, such as oil based hydraulic fluid, water based hydraulic fluid, water, sea water, or combinations thereof. One or more additives, such as amine fluid or corrosion inhibitors, can be disposed within the fluid. Other additives are available form Shell and Castrol.

At least one logic drum can be linearly disposed between the body and the sleeve for rotating and translating alternatingly between the first piston and the second piston. In a contemplated embodiment, the single fluid line sliding sleeve downhole tool assembly has an upper logic drum and a lower logic drum. The upper logic drum can be driven by the first pin into the sleeve while the lower logic drum is driven by the second pin into the sleeve. The one or more logic drums can be linearly secured to the sleeve by at least two fasteners, such as snap rings.

The logic drum can be linearly disposed between the body and the sleeve for rotating and translating alternatingly between the first piston and the second piston. It is contemplated that the logic drum can have a plurality of positioning slots. The logic drum can be linearly secured to the sleeve with at least two fasteners. An example of the fasteners can include snap rings that linearly capture the logic drum to the sleeve.

A first pin can be secured to a first shaft for engaging the first piston and the upper logic drum, and a second pin secured to a second shaft for engaging the second piston and the lower logic drum. The pins are for guiding axial movement of the sleeve and providing translational force on the sleeve. The pins can have a shape, such as cylindrical, rectangular, cubic, conical, or other polygonal shapes. The first pin and the second pin can have different shapes or identical shapes.

The present single fluid line sliding sleeve downhole tool assembly can also include a means for simultaneously actuating the first piston and the second piston, such as a hydraulic accumulator or a hydraulic pump. In an embodiment, the means for actuating the pistons can include one or more springs, a nitrogen chamber, an annulus assist, such as reservoir pressure, or combinations thereof.

The means for simultaneously actuating the pistons can be located on the single fluid line sliding sleeve downhole tool assembly. It is also contemplated that the means for simultaneously actuating the pistons can be located at the surface of a well, or elsewhere remote from or proximate to the present tool assembly.

In a contemplated embodiment, the single fluid line sliding sleeve downhole tool assembly can be adapted for use on subsea wells. The means for simultaneously actuating the pistons can be located on a drilling platform, on a floating platform, a fixed leg platform, drill-ship, a semi-submersible, or a similar vessel used in water.

The present single fluid line sliding sleeve downhole tool assembly can include a valve for relieving pressure build up in the first piston and the second piston. The pressure build up is generated as the pistons translate between each piston's original position and secondary position.

A choke can be in the body between the first piston and the second piston. The choke is also connected to the fluid source for supplying hydraulic fluid to the pistons as each piston moves from its original position to the secondary position.

A first relocating device can be used to relocate the first piston from the secondary position to the original position. A second relocating device can be used for relocating the second piston from the second piston secondary position to the second piston original position. The first and second relocation devices can be identical devices or different devices. The first relocating device and the second relocating device can be a spring, a nitrogen chamber, fluid from the annulus, fluid from the tubing, or combinations thereof.

The single fluid line siding sleeve downhole tool assembly has an open position and a closed position. In the closed position an equalizing port and the production port are isolated from the annulus port. In the open position the annulus port and the production port are aligned so that the annulus and the sleeve are in communication.

The embodiments of the invention can be best understood with reference to the figures.

Figure 2:
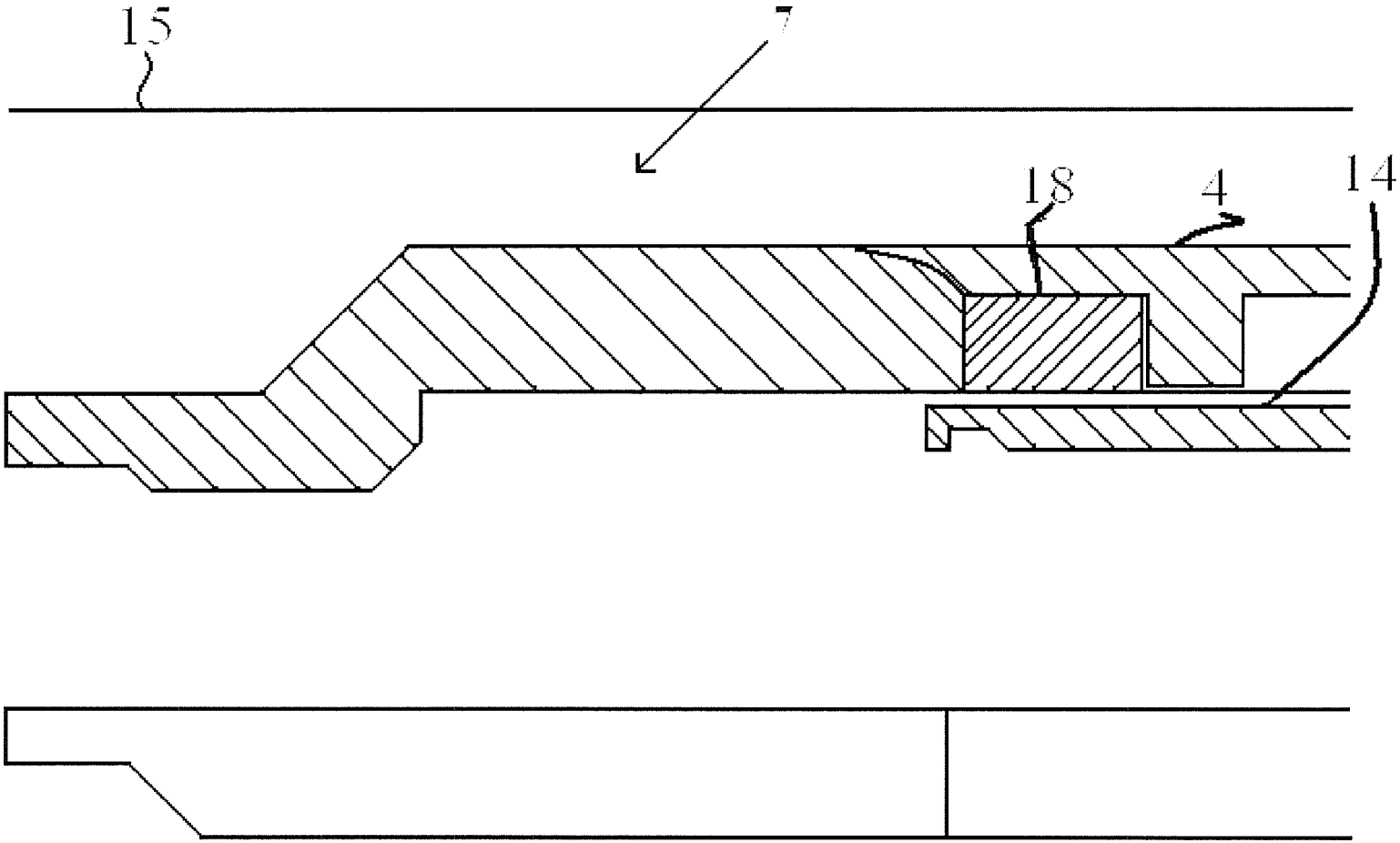
FIG. 2 depicts a cross sectional view of a top section of an embodiment of the present single fluid line sliding sleeve downhole tool assembly.

Referring now to FIG. 1 a cross sectional view of an embodiment of a central section of the present single fluid line sliding sleeve downhole tool assembly is depicted. A top connector 4 is depicted in communication with a body 6. The top connector can be a cylindrical threaded tubular member having a seal surface forming an inner diameter between 2.25 inches and 6.75 inches and an outer diameter between 2.5 and 7 inches. The top connector can made from carbon steel or another nickel alloy. The top connector can be between 1 foot and 4 feet long. In FIG. 2, the top connector 4 is further shown having an inner shoulder 69 creating an inner diameter between 0.25 inch and 0.5 inches in the top connector.

Returning to FIG. 1, the body 6 can be made from carbon steel or a nickel alloy steel. The body has an overall length ranging from one foot to ten feet. The body is generally tubular and cylindrical, but can be another shape than can run into a well, such as an oblong or elliptical shape. The body is contemplated to be mostly metal and have a tensile strength equal to or greater than the tubing in the body.

An upper logic drum 23*a* and a lower logic drum 23*b* are disposed between the body 6 and a sleeve 14 for rotating and translating alternatingly between a first piston 26 and a second piston 28.

The first piston 26 is disposed in the body 6 and connected to a fluid source 30, such as a fluid reservoir, a pressurized tank, a hydraulic tank, or a similar fluid containment device. The communication is through a single fluid line 71. The first piston 26 can be made from steel, another elastomeric material or a nonelastomeric material which enables the piston to slide in the chamber. The pistons have an outer diameter ranging from 0.25 inches to 1.5 inches and an overall length ranging from 0.25 inches to 2 inches. The first piston 26 is connected to a first shaft 27*a*. The first shaft 27*a* can have be made from steel or another material. The shaft can have a cylindrical shape or another polygonal shape.

The first shaft 27*a* is connected to a first pin 25*a*. The first pin 25*a* can have a cylindrical shape, a conical shape, a cubic shape, a rectangular shape, or a substantially similar shape. The first pin can range from 0.25 inches to 2 inches in length and have a diameter between ranging from 0.125 inches to 1.5 inches. The pin can be solid or hollow.

A second piston 28 is disposed within the body 6 opposite the first piston 26. The second piston 28 is also connected to the fluid source 30. The fluid communication is the single fluid line 71.

The second piston 28 is secured to a second shaft 27*b*, which can be substantially similar to the first shaft 27*a*. The second shaft 27*a* is secured to second pin 25*b*, which can be substantially similar to the first pin 25*a*. The second pin 25*b* can also have a different shape than the first pin 25*a*. The first pin 25*a* engages the upper logic drum 23*a*, and the second pin 25*b* engages the lower logic drum 23*b*.

A first plug 48*a* separates the body 6 from an adjacent annulus 7. A second plug 48*b* on the opposite side of the body 6 also separates the body 6 from the annulus 7. The first plug 48*a* and the second plug 48*b* can be steel plugs, non-elastomeric polymer plugs, such as nylon so long as it contains the pressure of the fluid at the temperatures for operation.

First plug 48*a* and second plug 48*b* provide a sealing engagement between the body 6 and the annulus 7. FIG. 1 also depicts a third plug 48*c*, separating the body 6 from the annulus 7, which can be substantially similar to first plug 48*a* and second plug 48*b*. It is also contemplated that first plug 48*a*, second plug 48*b*, and third plug 48*c* can be different types of plugs.

A valve 42 is depicted disposed within the body 6 between the body 6 and the annulus 7. An additional embodiment has the valve disposed within the body 6 between and the body 6 and the tubing. An additional embodiment has the valve disposed within the body 6 between and the body 6 and the surface via control line. The valve 42 can be operated to release pressure from within the body 6 created through the movement of first piston 26 and second piston 28. The valve 42 can be a check valve, or a check valve with a spring applying an additional force, such as part PRRA 2812080L from the Lee Company of Westbrook, Conn.

In an embodiment, valve 42 can be disposed between the body 6 and the tubing 15. This provides an advantage of reducing the time and costs associated with maintenance of valve 42.

A choke 44 is depicted disposed in the body 6 between the first piston 26 and the second piston 28. The choke 44 in one embodiment is a choke, such as the Visco Jet™ choke available also from the Lee Company as part number VHCA 1845112H. The choke 44 could also be pneumatic, or a combination of hydraulic and pneumatic chokes connected in series, wherein the chokes are connected to their respective fluid sources for supplying fluid. In an embodiment, fluid can be supplied from one fluid source to the first piston 26 and the second piston 28 as the pistons move.

FIG. 1 also depicts a first relocating device 46*a* disposed on the first shaft 27*a* for returning the first piston 26 from its secondary position to its original position. A second relocating device 46*b* is depicted disposed on the second shaft 27*b* for returning the second piston 26 from its secondary position to its original position.

The first relocating device 46*a* and the second relocating device 46*b* are depicted as springs, and can be coiled springs, wave springs, such as spring part number CO75-H6 from Smalley of Chicago, Ill., or a nitrogen chamber, such as a nitrogen chamber made by the Petroquip Energy Services Company of Houston, Tex.

A fluid source 30 is in fluid communication with the first piston 26 and the second piston 28. A filter 3 is disposed between the fluid source and the first piston.

FIG. 2 depicts a cross sectional view of an embodiment of a top section of the present single line single line sleeve downhole tool assembly.

A top sub 2, which can be made of carbon steel, or a nickel alloy, and can be made by PetroQuip Energy Services Company of Houston Tex., is depicted engaging the top connector 4.

A first seal assembly 18 is depicted providing a sealing engagement between the sleeve 14 and the top connector 4. The first seal assembly 18 can be any non elastomeric material.

Figure 3:
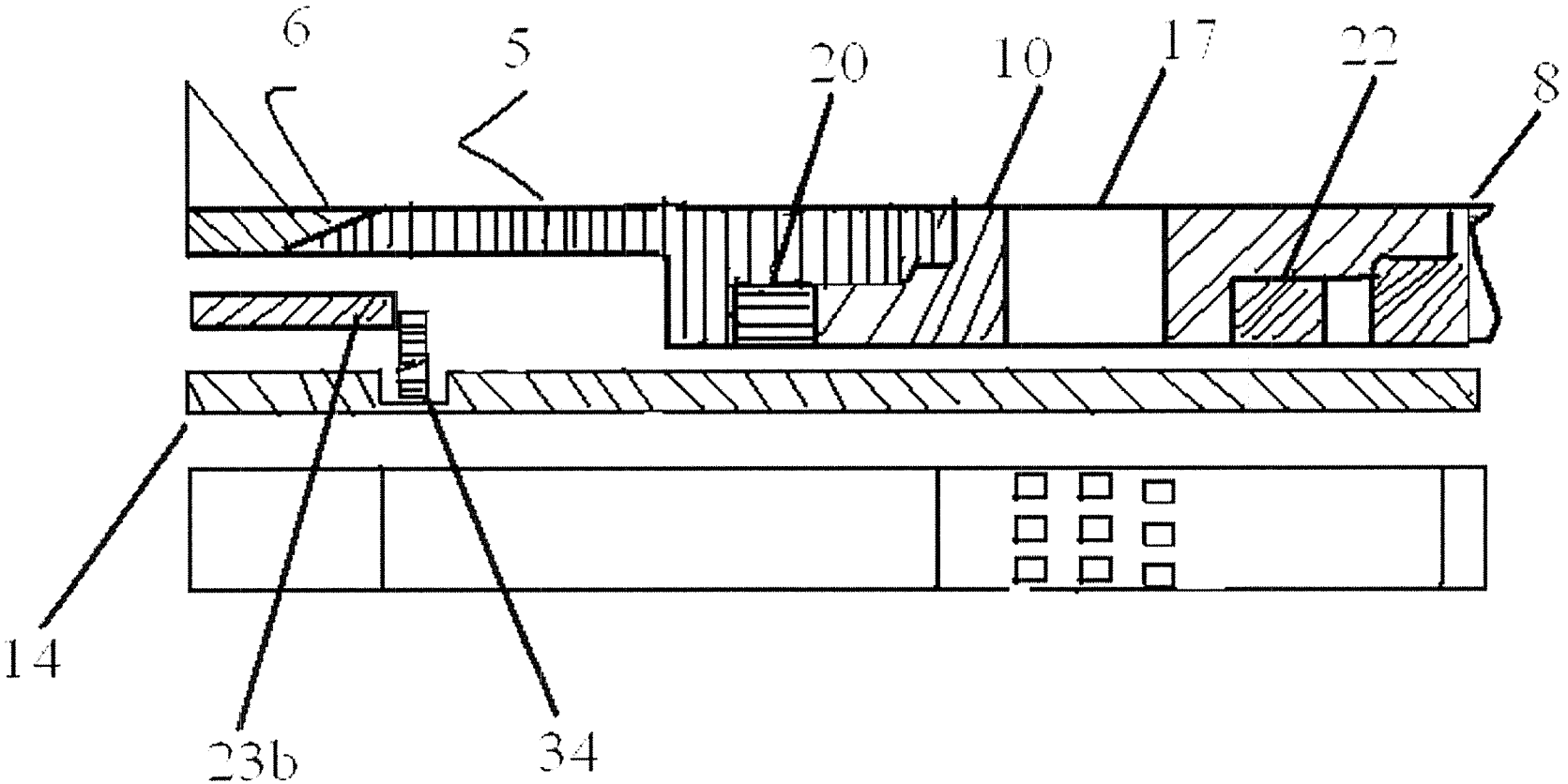
FIG. 3 depicts a cross sectional view of a mid-lower section of an embodiment of the present single fluid line sliding sleeve downhole tool assembly.

FIG. 3 depicts a cross sectional view of an embodiment of a mid-lower section of a single line single line sleeve downhole tool assembly.

A middle connector 5 is between the body 6 and a port housing 10. The middle connector 5 can be made from steel or a nickel alloy. The port housing 10 can also be made from steel or nickel alloy, such as the port housing available from Petroquip Energy Services Company, and can be a tubular member having a length ranging from 12 inches to 24 inches.

The port housing 10 engages a lower connector 8. The lower connector 8 is a tubular member with a threaded engagement on each end. The lower connector 8 does not have an inner shoulder. The overall length of the lower connector 8 can range from 6 inches to 2 feet and can have an inner diameter range from 2.25 inches to 5.75 inches. The lower connector can be made from a carbon steel or a nickel alloy.

An annulus port 17 is disposed within the port housing 10. The annulus port 17 can have an outer diameter ranging from 3 inches to 7 inches, and an inner diameter ranging from 2.25 inches to 5.75 inches.

The annulus port 17 flows fluid, such as hydrocarbons or similar wellbore fluids from the annulus 7 to the production port 16, then to the tubing 15 and to the production line 90.

FIG. 3 depicts a second seal assembly 20, which provides a sealing engagement between a middle connector 5 and the sleeve 14.

A third seal assembly 22 is depicted for providing a sealing engagement between the port housing 10 and the sleeve 14. The second seal assembly 20 and the third seal assembly 22 can be substantially similar to the first seal assembly 18, depicted in FIG. 2, and can be best understood with reference to FIG. 8.

In another embodiment the second seal assembly 20 and the third seal assembly 22 can be different types of seals. For example, a second seal assembly can be made from Teflon™, available from DuPont of Wilmingdton, Del., and a third seal assembly can be made from PEEK™ (polyester ester ketone), also made by Dupont.

In another embodiment, the second seal assembly can be made from a blend of a 95% PEEK and 5% Viton™ from Dupont.

The lower logic drum 23*b* is depicted in an operative position, secured to the sleeve 14 with a second fastener 34. The first fastener 32, depicted in FIG. 1, and the second fastener 34, shown in FIG. 3, work in concert to connect the upper logic drum 23*a* and the lower logic 23*b* to the sleeve 14. The first fastener 32 and the second fastener 34 can be a snap ring that captures the upper and lower logic drums 23*a* and 23*b* relative to the sleeve 14. The fasteners can be snap rings from Smalley, shear pins, shear screws, locking dogs, or combinations thereof.

Figure 4:
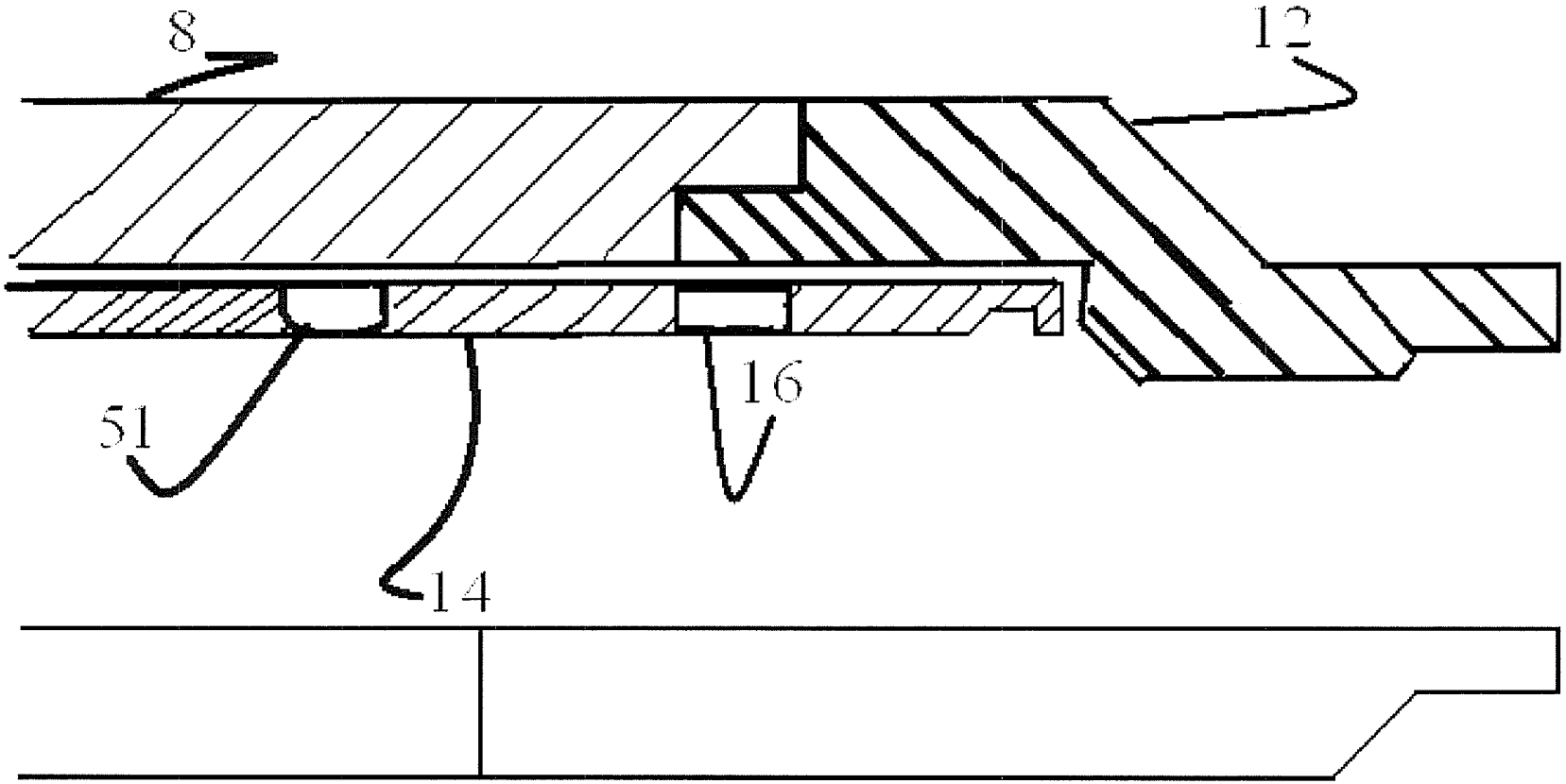
FIG. 4 depicts a cross sectional view of a bottom section of an embodiment of the present single fluid line sliding sleeve downhole tool assembly.

Referring now to FIG. 4, a cross sectional view of an embodiment of a bottom section of a single fluid line sliding sleeve downhole tool assembly is depicted. The sleeve 14 is depicted in an operative arrangement with a production port 16 for axially moving with respect to lower connector 8. Production port 16 allows a flow area equal or greater than the flow area of the tubing 15. The production port 51, which can have a diameter ranging from 0.025 inches to 3 inches is depicted. When the single line sliding sleeve assembly is in a closed position the equalizing port 51 and the production port 16 are isolated from the annulus port 17, and when in the open position the annulus port 17 and the production port 51 are aligned so that the annulus and the sleeve are in communication.

Figure 5A:
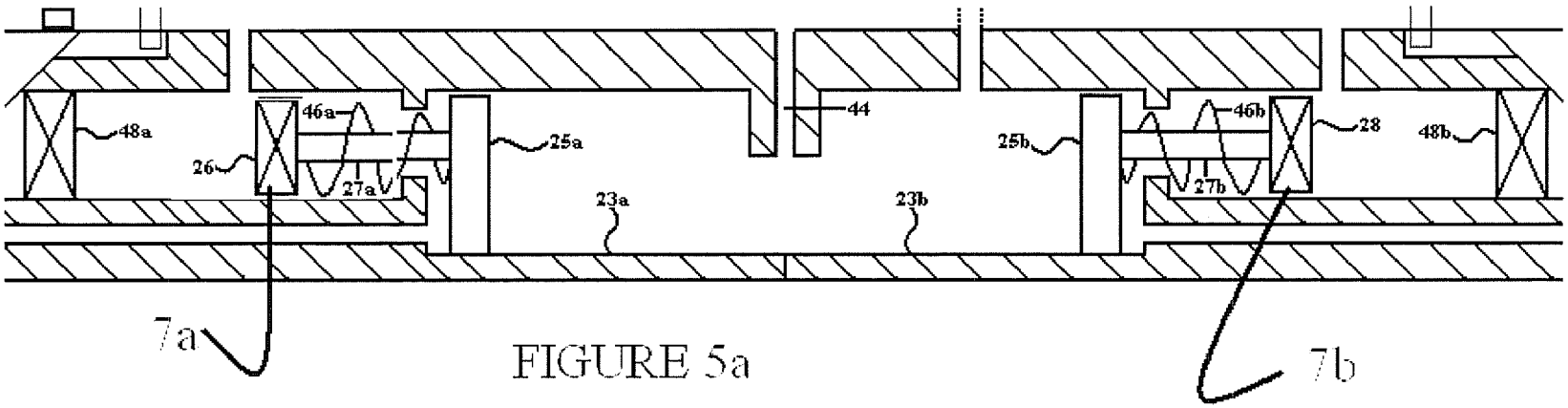
FIG. 5A depicts a cross sectional view of an embodiment of the present single fluid line sliding sleeve downhole tool assembly showing a piston in its original position.

Referring now to FIG. 5*a*, the first piston 26 is depicted within the body 6 in its original position. The first relocating device 46*a* is depicted extended. The second piston 28 is further depicted in its original position with second relocating device 46*b* extended.

Figure 5B:
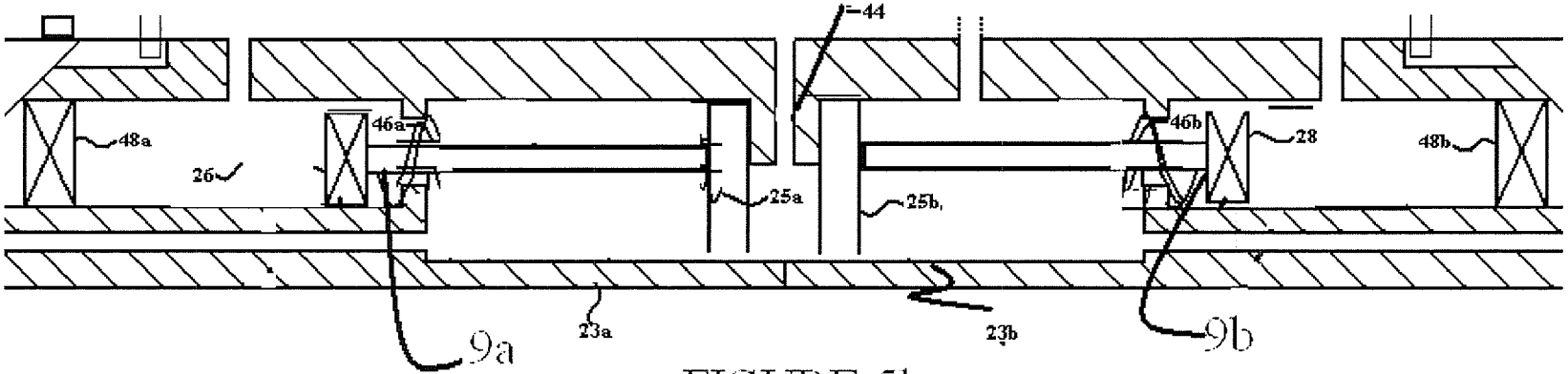
FIG. 5B depicts a cross sectional view of an embodiment of the present single fluid line sliding sleeve downhole tool assembly showing a piston in its secondary position.

FIG. 5*b* depicts the first piston 26 after the first piston 26 has moved axially within the body 6, achieving its secondary position. The first relocation device 46*a* is depicted compressed. The second piston 28 is further depicted its secondary position 9*b*, with second relocating device 46*b* compressed.

Figure 6:
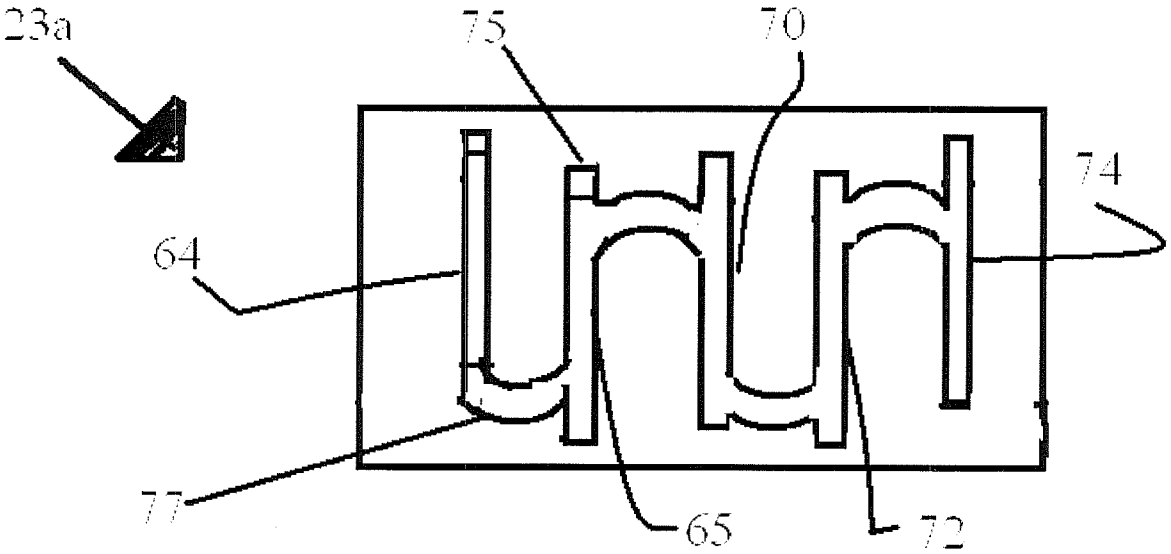
FIG. 6 is an unfolded view of an embodiment of the logic drum.
Figure 7:
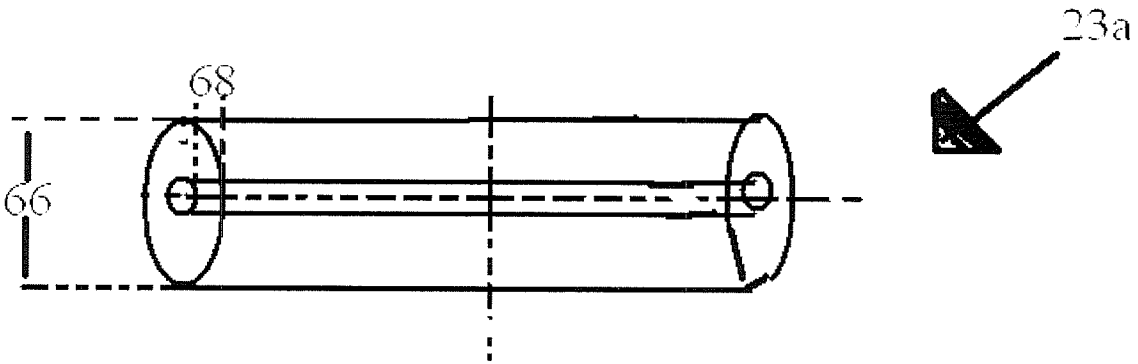
FIG. 7 is an isometric view of the embodiment of the logic drum.

An embodiment of the upper logic drum 23*a* is depicted in a unfolded view in FIG. 6 and an isometric view in FIG. 7. The upper logic drum 23*a* can have an overall diameter 66 ranging from 2.8 inches to 5.5 inches. The upper logic drum 23*a* can have a wall thickness 68 ranging from 0.125 inches to 0.5 inches. The upper logic drum 23*a* has at least two positioning slots.

In FIG. 6, a plurality of positioning slots 64, 65, 70, 72, 74 are disposed within the wall of the upper logic drum 23*a*. The positioning slots 64, 65, 70, 72, 74 can range from 25% to 75% of the length of the upper logic drum 23*a*. The upper logic drum 23*a* can have a length ranging from 8 inches to 60 inches. The positioning slots 64, 65, 70, 72, 74 can have a J shape. In an embodiment, the positioning slots can have a landing slot 75 and a rotation slot 77. The positioning slots 64, 65, 70, 72, 74 engage the pins within the landing slots 75 and remove torque. The positioning slots 64, 65, 70, 72, 74 can vary in length. The pins engage these slots for positioning the sleeve 14.

Figure 8:
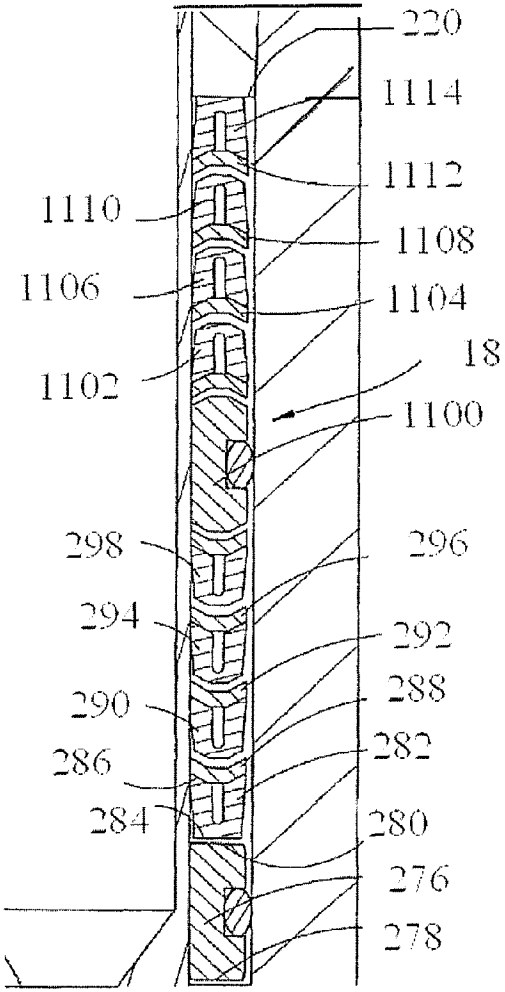
FIG. 8 is a cross sectional view of a seal assembly.

Referring now to FIG. 8, an exemplary seal assembly 18 is depicted. The seal assembly 18 comprises an equalizing seal means 276, wherein the equalizing seal means 276 can be constructed of filled PEEK, which is commercially available from Green Tweed under the name Arlon™. The PEEK has a tensile strength greater than 25,000 psi at 70 degrees F., and 13,000 psi at 350 degrees F. All seal means of the seal assembly 18 may be constructed of any equivalent type of material, such as Teflon, made by the DuPont Corporation.

An end 278 of the equalizing seal means 276 abuts the radial shoulder 222 and the opposite end 280 abuts the header seal ring means 282. The header seal means 282 can be constructed of filled PEEK. The header seal means 282 has a first end 284 and a second angled end 286. A non-extrusion ring 288 is included, which can be constructed of filled PEEK. The non-extrusion ring 288 comprises a concave shape and can prevent the extrusion and bulging of the ring members on either side.

The seal assembly 18 can further comprise a first seal ring means 290. The seal ring means 290 can constructed of filled PEEK. A second non-extrusion ring 292 can be provided, which in turn leads to a second seal ring means 294. The seal assembly 18 can also include a follower seal ring 1100, which can be constructed of filled PEEK. The follower seal ring 1100 has a first and second curved surface. A fourth seal ring means 1102 can be included wherein one end abuts the follower seal ring 1100 and the other end abuts a non-extrusion ring 1104.

A fifth seal ring means 1106 is provided that will in turn abut the non-extrusion ring 1108. The non-extrusion ring 1108 will then abut the sixth seal ring means 1110 that in turn will abut the non-extrusion ring 1112. The non-extrusion ring 1112 will abut the header seal ring 1114. The header seal ring 1114 will have an angled end abutting the back side of the non-extrusion ring 1108, and a second radially flat end that will abut the radial end 220.

Figure 9A:
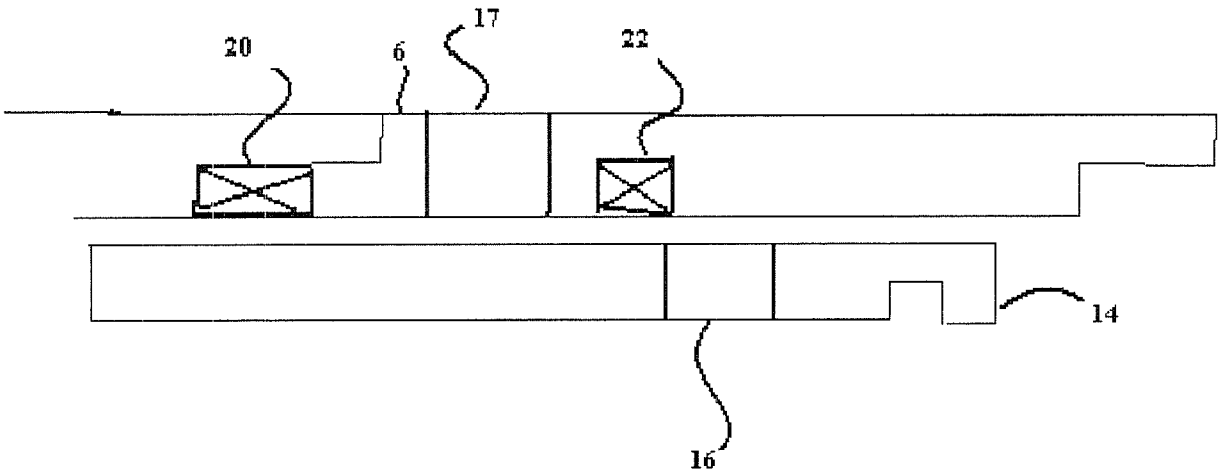
FIG. 9A is a cross sectional view of the sleeve of the present single fluid line sliding sleeve downhole tool assembly in a closed position.

Referring now to FIG. 9A, the sleeve of a single fluid line sliding sleeve downhole tool assembly is depicted in a closed position.

Sleeve 14 is depicted having a production port 16. Body 6 is depicted having annulus port 17, second seal assembly 20, and third seal assembly 22.

FIG. 9A depicts production port 16 disposed beneath third seal assembly 22, misaligned from annulus port 17, thereby preventing fluid from flowing through production port 16.

Figure 9B:
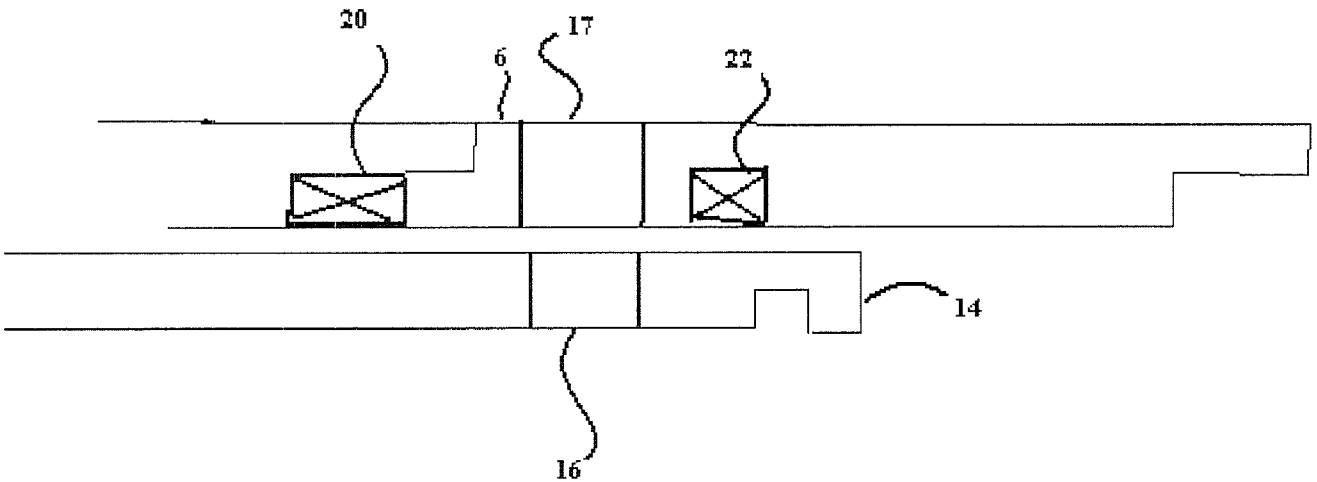
FIG. 9B is a cross sectional view of the sleeve of the present single fluid line sliding sleeve downhole tool assembly in an open position.

FIG. 9B depicts a cross sectional view of the single fluid line sliding sleeve downhole tool assembly depicted in FIG. 7*a* after sleeve 14 has moved axially into an open position.

Production port 16 of sleeve 14 is depicted in alignment with annulus port 17 of body 6, allowing fluid to flow through the aligned ports.

While these embodiments have been described with emphasis on the embodiments, it should be understood that within the scope of the appended claims, the embodiments might be practiced other than as specifically described herein.

What is claimed is:

1. A single line sliding sleeve downhole tool assembly comprising:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source from a single fluid line and wherein the first piston moves axially between at least an original position and at least a secondary position;

a second piston in communication with the fluid source from the single fluid line, and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston; and a first relocating device for relocating the first piston from the secondary position to the original position and a second relocating device for relocating the second piston from the second piston secondary position to the second piston original position.

2. The single line sliding sleeve downhole tool assembly of claim 1, wherein the first relocating device and the second relocating device comprise a spring, a nitrogen chamber, fluid from the annulus, fluid from the tubing, or combinations thereof.

3. The single line sliding sleeve downhole tool assembly of claim 1, further comprising a plurality of plugs for providing a sealing engagement between body and the annulus.

4. The single line sliding sleeve downhole tool assembly of claim 1, further comprising a first pin secured to a first shaft for engaging the first piston and the logic drum, and a second pin secured to a second shaft for engaging the second piston and the logic drum, wherein the first pin and second pin are for guiding axial movement of the sleeve and providing translational force on the sleeve.

5. The single line sliding sleeve downhole tool assembly of claim 4, wherein the first pin has a different shape from the second pin.

6. The single line sliding sleeve downhole tool assembly claim 1, wherein the means for actuating the first piston and the second piston is a hydraulic accumulator or a hydraulic pump.

7. The single line sliding sleeve downhole tool assembly of claim 1, wherein the means for actuating the first piston and the second piston is located at the surface of a well.

8. The single line sliding sleeve downhole tool assembly of claim 1, wherein the single line sliding sleeve downhole tool assembly is adapted for use on subsea wells, and the means for actuating the first piston and the second piston is located on a floating platform, a fixed leg platform, drill-ship, a semi-submersible, or a similar vessel used in water.

9. The single line sliding sleeve downhole tool assembly of claim 1, wherein the logic drum is linearly secured to the sleeve with at least two fasteners.

10. The single line sliding sleeve downhole tool assembly of claim 1, further comprising a filter disposed between the first piston and the second piston and the fluid source.

11. The single line sliding sleeve downhole tool assembly claim 1, further comprising a first pin secured to a first shaft for engaging the first piston and the at least one logic drum, and a second pin secured to a second shaft for engaging the second piston and the at least one logic drum, and wherein the at least one logic drum comprises an upper logic drum driven by the first pin into the sleeve and a lower logic drum driven by the second pin into the sleeve.

12. The single line sliding sleeve downhole tool assembly of claim 1, wherein the fluid is a compressible fluid or a non-compressible fluid.

13. The single line sliding sleeve downhole tool assembly of claim 12, further comprising an additive combined with the fluid.

14. The single line sliding sleeve downhole tool assembly of claim 1, wherein the body is eccentric.

15. The single line sliding sleeve downhole tool assembly of claim 1, wherein the assembly has an open position and a closed position and wherein in the closed position an equalizing port and the production port are isolated from the annulus port and wherein in the open position the annulus port and the production port are aligned so that the annulus and the sleeve are in communication.

16. The single line sliding sleeve downhole tool assembly of claim 1, wherein the means for actuating the first piston and the second piston simultaneously actuates the first and second pistons.

17. The single line sliding sleeve downhole tool assembly claim 1, further comprising a valve for relieving pressure build up in the first piston and the second piston as the first piston moves axially between the original position and the secondary position and the second piston moves axially between the second piston original position and the second piston secondary position.

18. The single line sliding sleeve downhole tool assembly of claim 17, wherein the valve is disposed between the body and the tubing.

19. The single line sliding sleeve downhole tool assembly of claim 1, further comprising a choke in the body between the first piston and the second piston connected to the fluid source for supplying fluid to the first piston and the second piston as the first piston moves axially between the original position and the secondary position and the second piston moves axially between the second piston original position and the second piston secondary position.

* * * * *